US009348314B2

(12) United States Patent
Robin

(10) Patent No.: US 9,348,314 B2
(45) Date of Patent: May 24, 2016

(54) ASSEMBLY BETWEEN A DIAL AND A TIMEPIECE MOVEMENT

(71) Applicant: ROLEX SA, Geneva (CH)

(72) Inventor: Jean-Baptiste Robin, Annemasse (FR)

(73) Assignee: ROLEX S.A., Geneva (CH)

( * ) Notice: Subject to any disclaimer, the term of this patent is extended or adjusted under 35 U.S.C. 154(b) by 0 days.

(21) Appl. No.: 14/103,312

(22) Filed: Dec. 11, 2013

(65) Prior Publication Data

US 2014/0160905 A1 Jun. 12, 2014

(30) Foreign Application Priority Data

Dec. 12, 2012 (EP) ..... 12196614

(51) Int. Cl.
*G04B 19/06* (2006.01)
*G04B 19/14* (2006.01)

(52) U.S. Cl.
CPC ..... *G04B 19/06* (2013.01); *G04B 19/14* (2013.01)

(58) Field of Classification Search
CPC ..... G04B 19/06; G04B 19/14; G04B 37/05
USPC ..... 368/80, 88, 223, 228, 232, 236, 237
See application file for complete search history.

(56) References Cited

U.S. PATENT DOCUMENTS

| | | | | |
|---|---|---|---|---|
| 1,338,745 | A * | 5/1920 | Maloney | 368/236 |
| 2,039,672 | A * | 5/1936 | Whitehead | 368/294 |
| 3,283,496 | A * | 11/1966 | Hobenthaner | 368/80 |
| 4,207,735 | A * | 6/1980 | Ishigaki et al. | 368/300 |
| 8,325,565 | B2 * | 12/2012 | Hiranuma et al. | 368/236 |

FOREIGN PATENT DOCUMENTS

| | | | |
|---|---|---|---|
| CH | 282448 | A | 4/1952 |
| CH | 316203 | A | 9/1956 |
| CH | 353310 | A | 3/1961 |
| FR | 1003696 | A | 3/1952 |
| FR | 1260354 | A | 5/1961 |
| FR | 2077399 | A1 | 10/1971 |
| GB | 2079497 | A | 1/1982 |

OTHER PUBLICATIONS

European Search Report for EP 12196614, Mailing date of May 29, 2013.

* cited by examiner

*Primary Examiner* — Vit W Miska
(74) *Attorney, Agent, or Firm* — Westerman, Hattori, Daniels & Adrian, LLP

(57) ABSTRACT

Dial (1) for a timepiece, comprising a disc (2) intended to be positioned substantially parallel to a timepiece, and a skirt (3) extending in a direction substantially perpendicular to the disc (2) of the dial, characterized in that the skirt (3) comprises at least one elastic element (10) which extends partially over the height of the skirt to retain the dial axially on a timepiece movement.

27 Claims, 5 Drawing Sheets

ASSEMBLY BETWEEN A DIAL AND A TIMEPIECE MOVEMENT

INTRODUCTION

The present invention relates to a dial for a timepiece, to a clockwork assembly incorporating such a dial collaborating with a timepiece movement. It also relates to a timepiece as such, incorporating such an arrangement, such as a wristwatch.

PRIOR ART

A first solution of the prior art for fixing a watch dial to a frame requires pins projecting under the lower surface of the dial. These pins become housed in cutouts arranged on the upper surface of the frame. Screws positioned within the frame are used to press against the pins and immobilize them, to prevent any detachment of the dial from the frame. This method of fixing has a first disadvantage of not being very user-friendly and unreliable because a number of screws have to be manipulated. It has a second disadvantage of being bulky and therefore of not being usable on watches that have numerous functions, which need to take up a large proportion of the available surface area, such as in the case of a watch with a date function, unless the overall diameter of the watch is greatly increased at the expense of the aesthetic appearance. Finally, another disadvantage with this solution is that it carries the risk of generating a situation of static indeterminacy if the elements involved in the attachment do not achieve the perfect precision required.

Document CH353310 discloses a solution that differs from the preceding one, in which the pins are replaced by elastic projections which engage in cutouts in a watch bottom plat. This solution avoids the use of screws from the preceding solution but maintains the other disadvantages. In addition, it relies on elements of complex geometry.

Another solution, described in document GB2079497, simplifies the connecting elements by positioning simple elastic arms on the periphery of a flat dial, these collaborating with tenons attached to the top face of the frame of the timepiece. However, this solution requires a large surface area, notably on which to position these elastic arms. The use of tenons is also complex because these tenons have to be preassembled before the dial is fitted.

Document CH282448 describes another approach to attaching a dial which is provided with a dial disc and with an annular skirt. The latter covers the lateral surface of the frame, allowing it to attach the dial to the frame using screws or pins. This solution is still not very user-friendly because it requires screw-fastening operations and external fixings.

Finally, documents FR2077399 and FR1003696 describe another solution, in which the dial comprises a dial disc and elastic tabs on its periphery, which extend downwards. These elastic tabs collaborate with a frame of the movement or a fixing ring attached to the frame of the movement. They are able to move elastically about their horizontal axis of connection to the dial disc, arranged towards their upper end. When the dial is attached, these tabs part elastically towards the outside of the dial about their axis of connection and become lodged in a lower part under the fixing ring. As the axis of connection of these tabs is oriented in a direction parallel to the dial disc, the active length of the tabs is limited to the total height of the dial. This geometry is ill suited to a high number of assembly/disassembly operations and is unable to guarantee lasting reliability of the fixing. Furthermore, with such a tab geometry it is necessary to achieve very precise dimensioning of the tabs of the dial and of the frame with which the dial tabs collaborate. This is because, in order to prevent the tabs from undergoing plastic deformation or even breaking, it is necessary to have small interactions and small dimensional variations of the components. Because of these constraints, these designs are not very robust and are incompatible with sizable productions. These tabs are also designed simply to hold the dial but not to keep it central.

Finally, all of the existing solutions are unable to achieve a satisfactory result and the overall objective of the invention is to propose a solution for attaching a timepiece dial to a timepiece movement, such as a watch frame for example, that allows an optimum compromise to be reached between simplicity and convenience of handling, smallness of size, reliability and aesthetic appearance.

BRIEF DESCRIPTION OF THE INVENTION

To this end, the invention relies on a dial for a timepiece which dial is equipped with a skirt and comprises at least one elastic element which extends partially over the height of the skirt and is able to perform the function of holding the dial axially on a timepiece movement.

The invention is more precisely defined by the claims.

BRIEF DESCRIPTION OF THE FIGURES

These objects, features and advantages of the present invention will be set out in detail in the following description of particular embodiments which are given nonlimitingly with reference to the attached figures among which:

FIGS. 1, 3 and 4 depict two components of a clockwork assembly according to one embodiment of the invention. First of all, a dial 1 comprises a disc 2 in the form of a flat disc and a skirt 3 which extends in a direction substantially perpendicular to the disc around the circumference thereof. This dial 1 is intended to collaborate with a timepiece movement 20, such as a watch frame, which is thus also in the overall shape of a disc. FIG. 1 depicts the dial 1 facing a timepiece movement 20 but not attached thereto.

Figure 1:
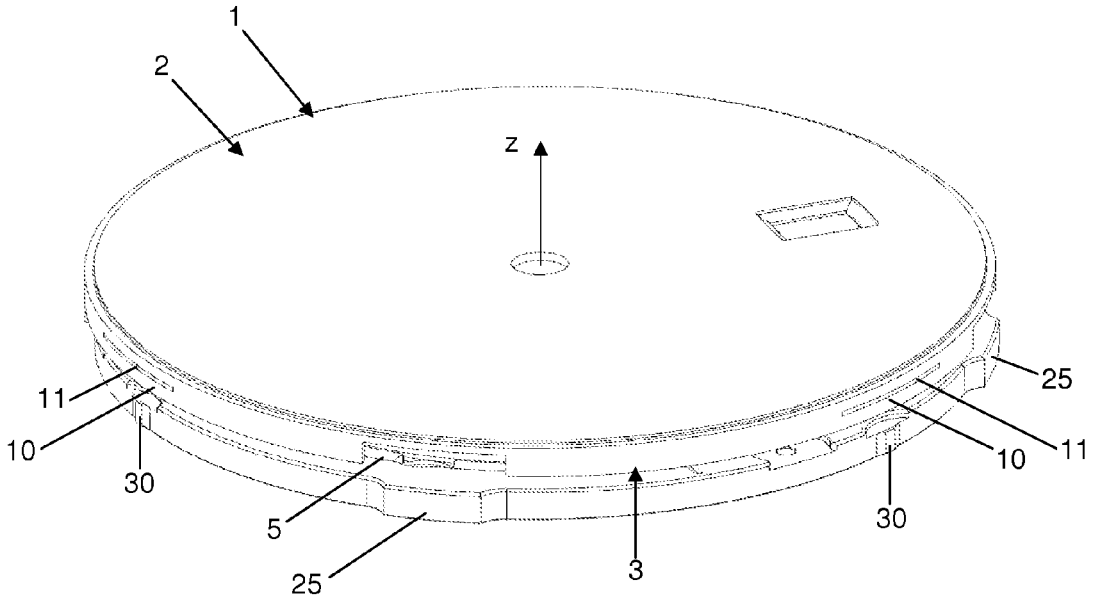
FIG. 1 depicts a perspective view from above of a clockwork arrangement according to one embodiment of the invention.
Figure 2:
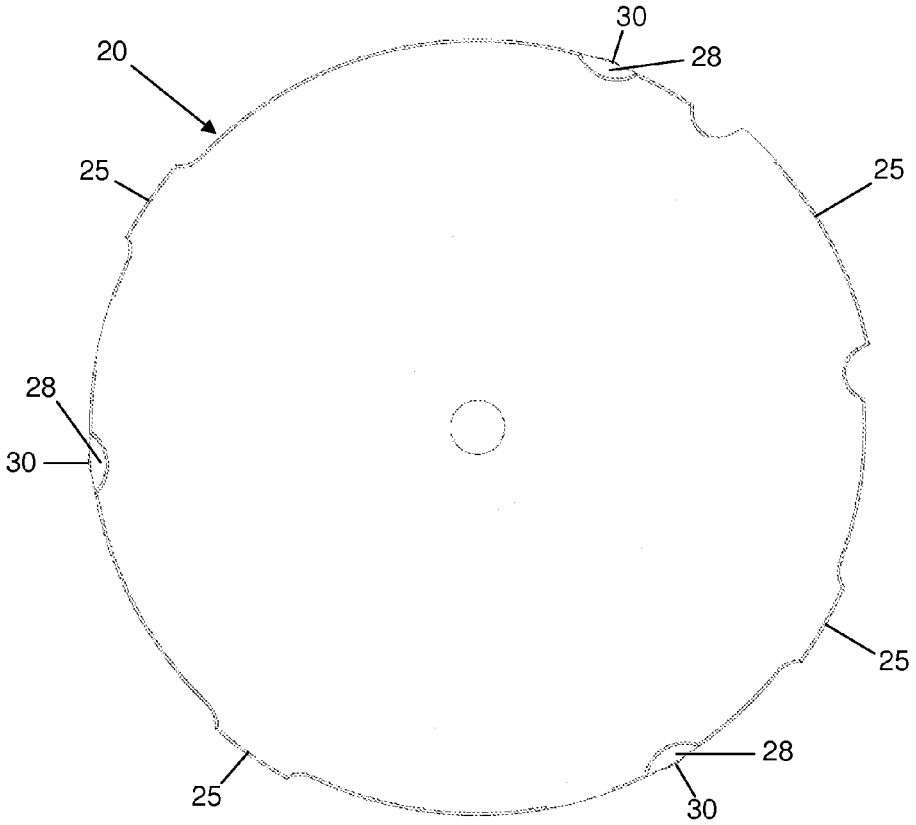
FIG. 2 depicts a view from above of a movement—with which the dial collaborates according to the embodiment of the invention.
Figure 3:
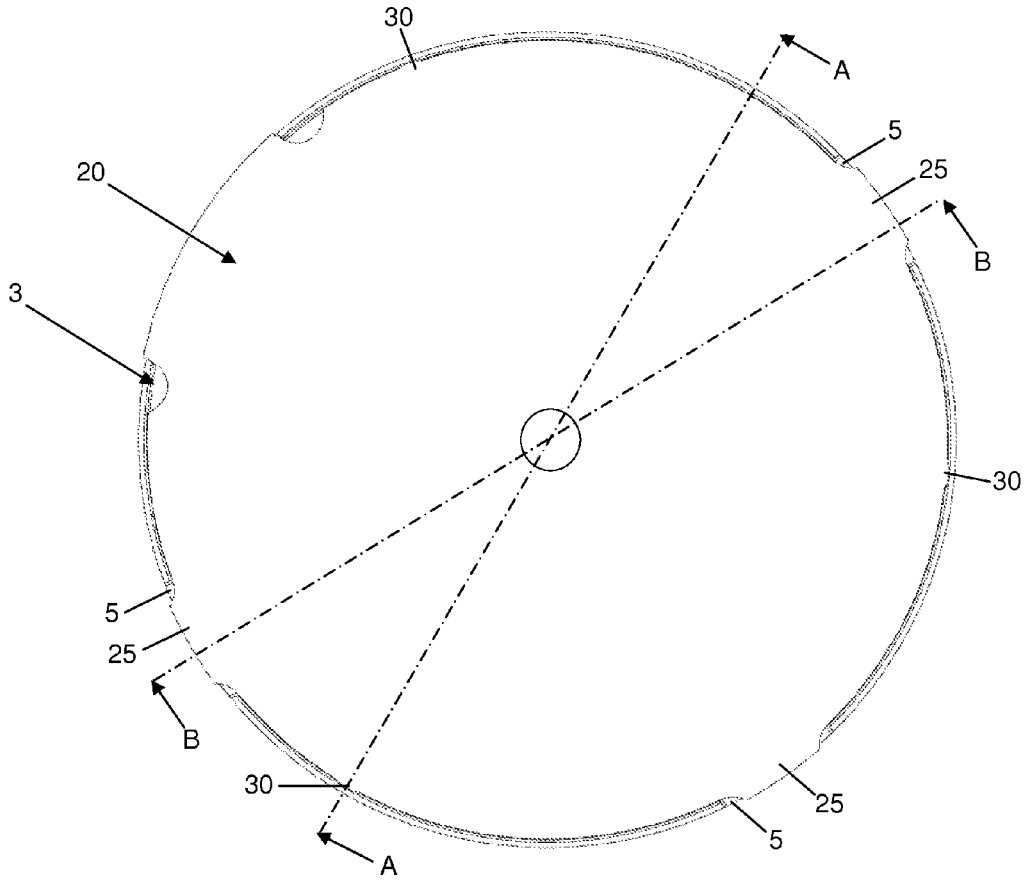
FIG. 3 depicts a view from underneath of the assembly of the dial with the timepiece movement according to the embodiment of the invention. This figure defines the planes of section A-A and B-B used for some of the subsequent figures.

By convention, we choose to define the horizontal direction as a plane parallel to the disc 2 of the dial, and the vertical direction z as the direction perpendicular to it, oriented from the timepiece movement towards the dial. With this convention, which simplifies the following description, the skirt 3 therefore extends vertically downwards from the disc 2 of the dial, and the dial 1 is fixed to the timepiece movement 20 by bringing the dial vertically closer over the timepiece movement. This vertical direction of attachment of the two components will also be referred to as the axial direction hereinafter, with reference to the axis of the disc shapes that form the two components of the assembly. In addition, the tangential direction will refer to any direction tangential to a circle centred on an axis in the axial direction, notably the axis of the disc shapes that form the two components of the assembly. The person skilled in the art will appreciate that these terms thus defined can be used whatever the shape of the dial and/or of the timepiece movement, which is not necessarily a circular shape.

The dial 1 according to the embodiment of the invention comprises on its skirt 3 elastic elements 10 in the form of elastic blades oriented tangentially relative to an axis in the axial direction, and formed by simple through-slots 11 made in the skirt 3. These elastic elements 10 have the function of fixing the dial axially to a timepiece movement, as will be detailed later on. In the example illustrated, the skirt comprises three elastic blades equally distributed about its circular contour, namely every 120 degrees. The skirt also comprises cutouts 5 extending over a significant part of its height, the function of these being to index the dial angularly on the timepiece movement.

The timepiece movement 20 comprises additional elements designed to collaborate with the elastic elements 10 and the cutouts 5 of the skirt 3 of the dial. Thus, the timepiece movement 20 is in the shape of a disc with a diameter slightly smaller than that of the dial, so that the skirt 3 of the dial covers its external contour positioning the disc 2 of the dial on the timepiece movement 20. The latter also comprises, on its lateral surface that forms its external contour, first protrusions 30 which project from this surface and are intended to collaborate with the elastic elements 10 of the dial, and possibly second protrusions 25 which likewise project and are designed to collaborate with the cutouts 5 in the skirt. These protrusions are arranged at a height and with an angular distribution which are defined according to the geometry of the skirt of the dial.

Figure 5:
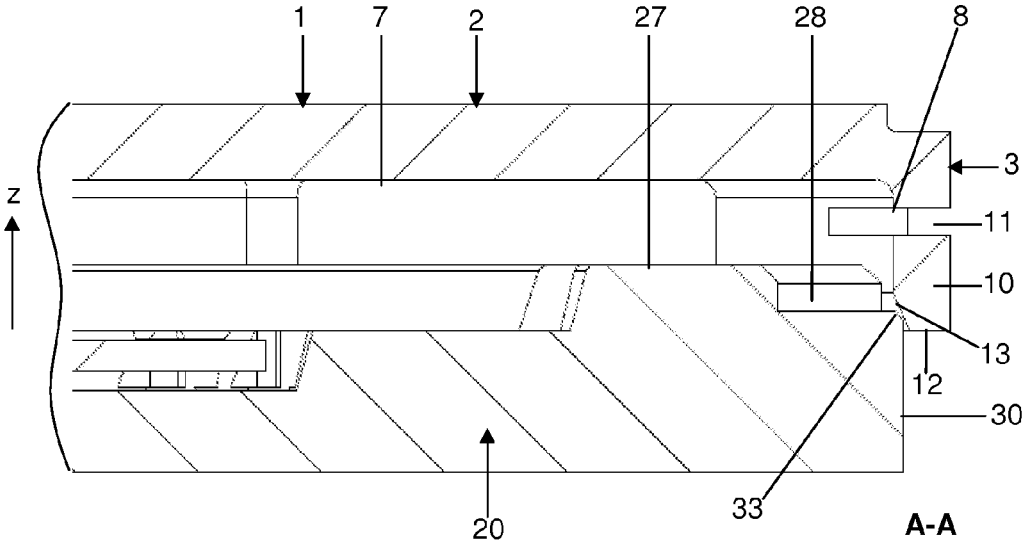
FIGS. 5 and 6 depict view in cross section on A-A to illustrate how the fixing of the dial to a timepiece movement works in the embodiment of the invention.
Figure 6:
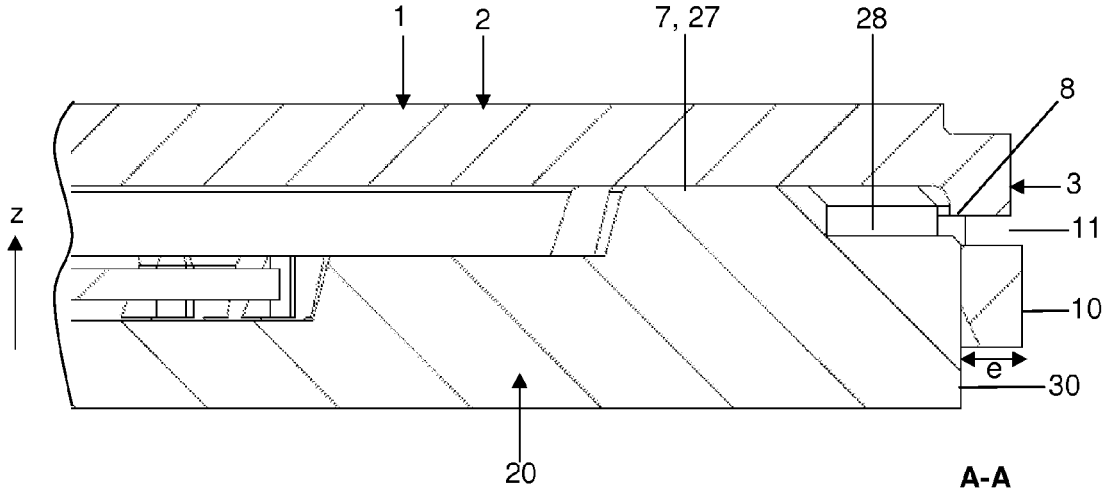

FIGS. 5 and 6 more specifically illustrate how the solution according to this embodiment works.

FIG. 5 depicts the dial 1 during the phase in which it is brought up close over the timepiece movement 20. The lower end 12 of an elastic element 10 of the skirt 3 comes into contact with the upper surface of a protrusion 30 of the contour of the timepiece movement 20. To make the relative positioning of the two components easier, a surface in the form of an entry taper or chamfer 13 is formed at the interior surface of the skirt, i.e. oriented towards the timepiece movement 20, towards this lower end of the blade. This surface in the form of an entry taper or chamfer 13 comes into contact with a rounded or chamfered contour of the external corner of the top surface 33 of the protrusion 30 of the timepiece movement 20. These two contacting surfaces have a geometry which encourages the blade to move and deform against the protrusion 30.

When the dial 1 continues its downwards movement, the blade is moved aside by the protrusion 30, deforming elastically. This movement continues until the underside surface 7 of the disc 2 comes to rest against the top surface 27 of the timepiece movement 20, or, as an alternative, until any form of abutment arranged between the two components to halt this axially directed movement is reached. In this embodiment, the top surface 27 of the timepiece movement 20 has a cutout 28 to allow the lower and inner edge corner 8 of the skirt 3 to be positioned in the region of the slot 11 that delimits the elastic element 10, so that the downwards movement of the disc 2 is not blocked until it is pressing on the timepiece movement 20 in the region of the protrusion 30.

In the final position depicted by FIG. 6, the dial is held in its axial direction by the elastic return force exerted by the elastic element 10 of the skirt 3 on the protrusion 30 of the timepiece movement 20. The dial 1 is thus held on the timepiece movement 20 by friction. In other words, the dial 1 is clipped onto the timepiece movement 20.

It should be pointed out that during this phase of fixing the dial to the timepiece movement, a preliminary phase of angularly indexing the dial is preferably carried out in order to ensure that the two components are correctly positioned relative to one another, during which phase the elastic elements 10 of the skirt begin to collaborate with the corresponding elements of the timepiece movement, i.e. the protrusions 30 in the example illustrated. For that, in the position depicted by FIG. 5 for example, the dial is turned relative to the timepiece movement until at least one of the sidewalls of a cutout 5 comes into abutment against a corresponding protrusion 25. This angular indexing can alternatively be obtained by any other means and the second protrusions 25 are chosen here by way of example.

Figure 7:
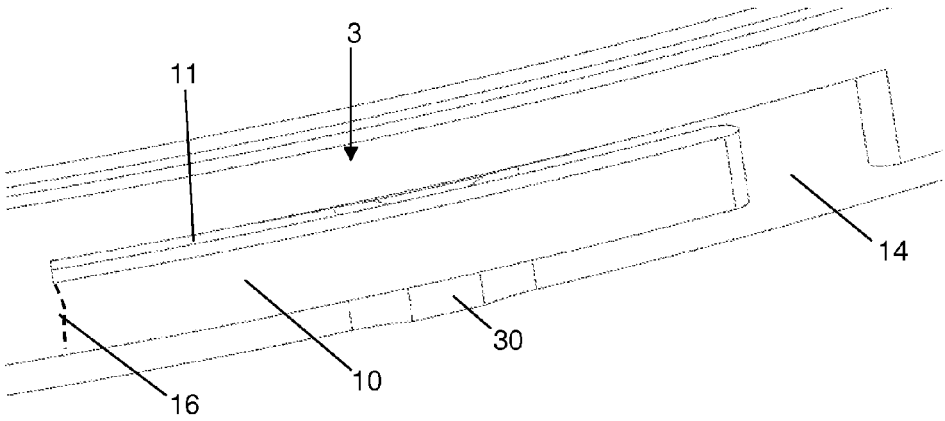
FIG. 7 illustrates a side view of the arrangement of the dial on the timepiece movement at a fixing according to an alternative form of the embodiment of the invention.

FIG. 7 illustrates an alternative form of embodiment of an elastic element 10 of the skirt 3 of the dial. In this alternative form, an additional cutout or slit 14 is formed in the skirt 3, in a substantially vertical direction perpendicular to the slit 11 described earlier, to form a blade which is now built in (or simply connected) to the skirt only by one single end 16, whereas in the preceding direction it was built in at both ends 16.

Figure 8:
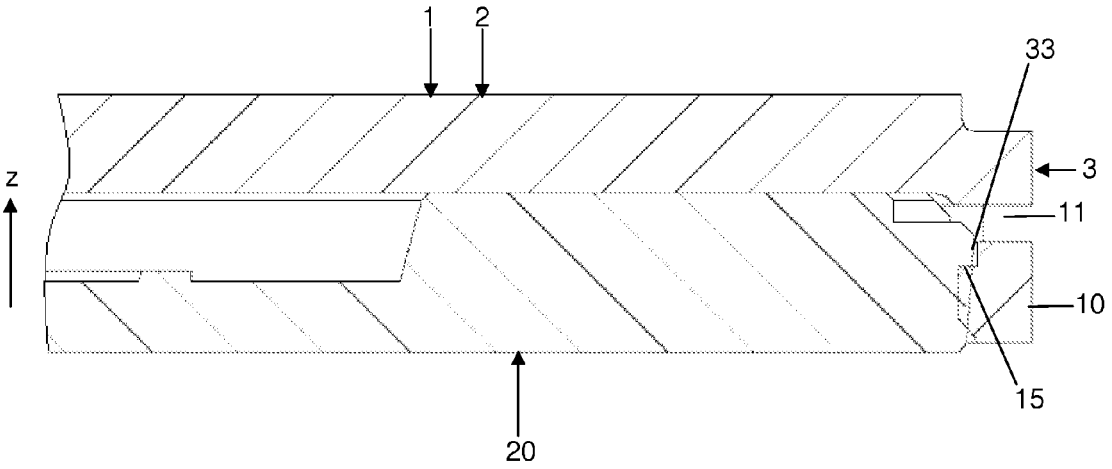
FIG. 8 illustrates a view in cross section of details of the clockwork arrangement in the region of a fixing according to an alternative form of the embodiment of the invention.

FIG. 8 depicts another alternative form of embodiment, in which the axial retention of the dial is reinforced by the fact that the elastic element snags onto the timepiece movement. To do that, the protrusion is modified so that it has a slightly inclined flank, for example inclined by the order of 5 degrees, in which a discontinuity 33 is formed in the upper part, under which, through an elastic effect, the upper end 15 of the elastic element 10, the geometry of which complements that of the discontinuity 33, becomes lodged during the phase of fixing the dial to the timepiece movement. Axial retention is thus assured by the combination of the elastic clipping effect of the elastic element and the hooking effect of abutment of the top surface of the elastic element against the underside face of the discontinuity 33. The elastic element is thus snagged on the protrusion 30.

Naturally, a great number of the components of the dial and of the timepiece movement could adopt different forms.

First, the number of elastic elements of the skirt of the dial has been chosen to be three in the embodiment described hereinabove. However, any other number could be chosen, even one perhaps being sufficient to provide axial retention. For preference, there are several elastic elements, they are equally distributed about the circumference of the skirt to encourage the dial to sit centrally relative to the timepiece, and thus encourage the dial to sit centrally relative to any display members there might be. It should be noted that the geometry of these elastic elements is such that it allows them both to retain the dial and to centre the dial. Furthermore, an elastic element collaborates with a complementary element belonging to the timepiece movement, such as a protrusion. For preference, the elastic element of the skirt of the dial is centred with respect to this complementary element belonging to the timepiece movement.

Figure 4:
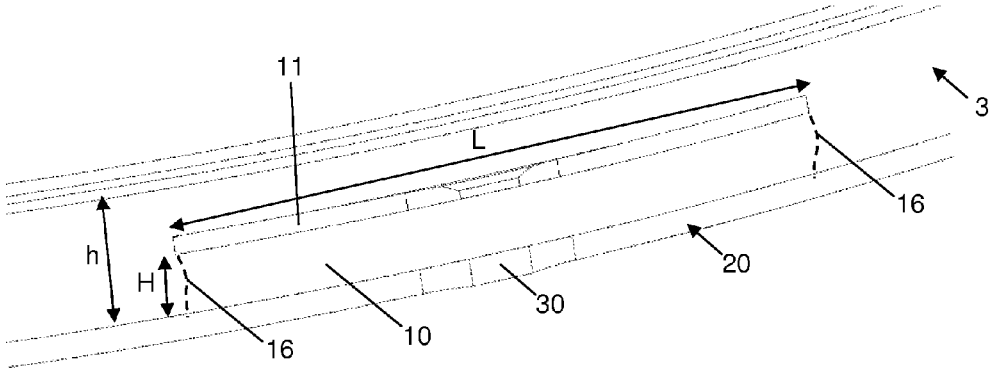
FIG. 4 illustrates a side view of the clockwork arrangement in the region of a fixing of the dial according to the embodiment of the invention.

According to the embodiment illustrated, an elastic element is obtained by at least one slit made in the skirt, and more particularly visible in FIGS. 4 and 7. Such a slit 11 may extend tangentially over an angular sector varying between 10 and 30 degrees, in the case of a circular dial. Through this choice, for a dial approximately 15 mm in diameter, a slit extending over an angular sector of 20 degrees allows the creation of a blade with an active length L of the order of 5 mm. This active length L is preferably between 3 and 10 mm. Further, this slit is positioned to form an elastic blade of height H less than or equal to 2 mm, or less than or equal to 1 mm, or less than or equal to 0.7 mm, for example around 0.5 mm or less than or equal to 0.5 mm, or less than or equal to 0.3 mm. In addition, the skirt may be made of metal, notably an elastic metal such as a coppery or precious metal, of a thickness e of between 0.2 and 0.4 mm.

The elastic element has been depicted in the form of an elastic blade running tangentially. Naturally, it is possible to use an elastic blade extending in any direction, preferably with a non-zero horizontal component or even with an angle that is somewhat small relative to the horizontal direction. More generally, the elastic element of the skirt is advantageously able to move about at least one end 16, fixed to the skirt and not parallel to the disc of the dial, i.e. not horizontal. This end 16 may notably be substantially perpendicular to the disc of the dial.

Furthermore, this elastic element is formed by means of a blade produced directly in the skirt using at least one slit. This solution has the advantage of simplicity and forms a continuous assembly, the blade being connected to the skirt by at least one end 16 belonging to the skirt. For preference, this slit is substantially parallel to the disc of the dial. As an alternative, a blade separate from the skirt could be added on and fixed to the surface of the skirt by any means. As yet another alternative, this elastic element could adopt some other form, and no longer take the form of a blade.

Through such a construction, the elastic element does not extend over the entire height h of the skirt but over just part of this height h, partially over this height h, allowing it to achieve elastic properties that are well suited to the desired form of fixing. This height H of the elastic element, or more generally its width if this element is not horizontal, may preferably represent less than two-thirds of the total height h of the skirt, or even less than half of this height, or even less than one third of the total height h of the skirt.

The dial may also comprise an additional surface intended to come to press against a surface of the frame when the watch is being assembled in order ultimately in the final position to rest against the timepiece movement and against another component, such as the timepiece middle.

The dial is advantageously made of a coppery material, such as a brass for example. As an alternative, it may be made of a precious material, such as gold or platinum. As an alternative, any other material having elastic and/or mechanical properties suited to use of the concept described hereinabove may be employed.

Alternatively, these components of the clockwork assembly may be angularly indexed using an ancillary means, such as a pin for example, or any other means.

Figure 9:
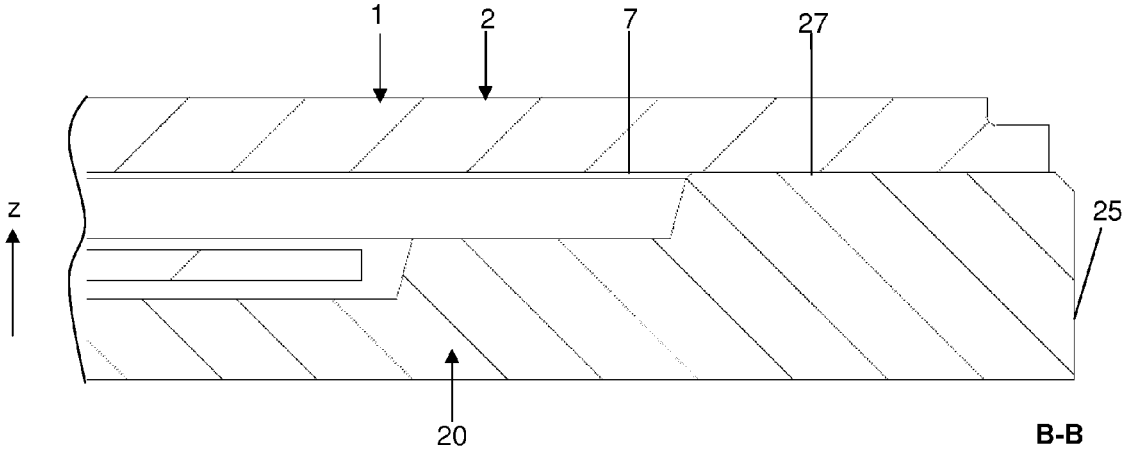
FIG. 9 illustrates a view in cross section on B-B of the clockwork arrangement according to one embodiment of the invention.

The timepiece movement may even have a different geometry. In particular, a first protrusion intended to collaborate with an elastic element of a skirt of the dial may form a projection or additional thickness of the contour representing between 0.01 and 0.2 mm. This value is advantageously chosen to correspond to the deflection of the elastic element of the dial. Each first and/or second protrusion 30, 25 may also form an upper bearing surface 27, accepting a lateral part of the underside surface 7 of the dial, as can be seen in section B-B of FIG. 9.

Figure 10:
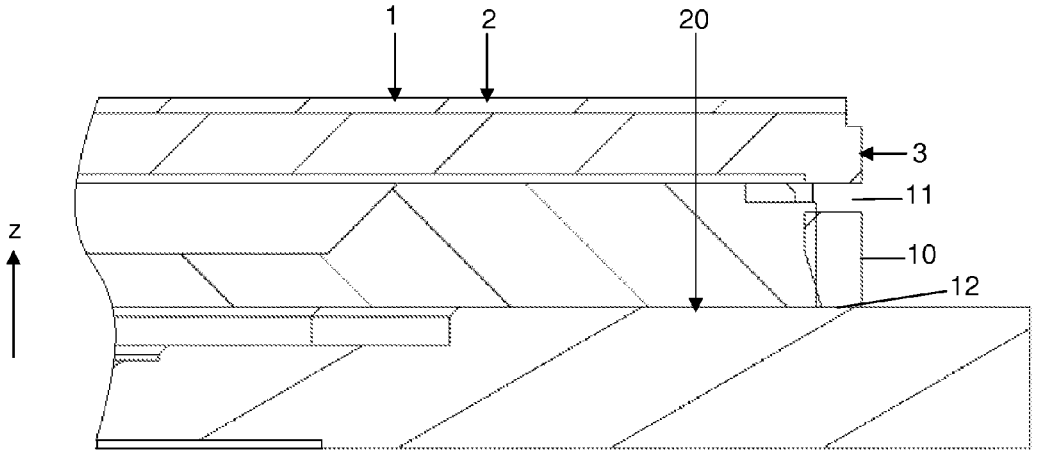
FIG. 10 illustrates a view in cross section of details of the clockwork arrangement according to an alternative form of the embodiment of the invention.

In an alternative form of embodiment depicted in FIG. 10, the skirt of the dial comprises an underside surface 12 which comes to rest against a surface of the timepiece movement.

Finally, the embodiment described discussed the most commonplace shape of a circular watch, but any arbitrary shape to suit the aesthetic look of a timepiece may be suitable, such as a rectangular or elliptical shape. The clockwork assembly described hereinabove is suited to use in various timepieces, such as watches.

The invention claimed is:

1. Dial for a timepiece, comprising:

a disc intended to be positioned substantially parallel to the timepiece, and a skirt extending in a direction substantially perpendicular to the disc of the dial, wherein the skirt comprises a skirt body and at least one elastic element which extends partially over a height of the skirt to retain the dial axially on a timepiece movement, wherein the at least one elastic element has a first end fixed to the skirt body, so that the at least one elastic element is configured to be moved relative to the skirt body, and wherein a direction of movement of the at least one elastic element is substantially parallel to a plane defined by the disc of the dial.

2. Dial for a timepiece according to claim 1, wherein the at least one elastic element does not extend over a total height of the skirt in the direction substantially perpendicular to the disc of the dial, and wherein a height of the at least one elastic element in the direction substantially perpendicular to the disc of the dial is less than two-thirds of the total height of the skirt.

3. Dial for a timepiece according to claim 1, wherein the elastic element has one end fixed on the skirt and oriented in a direction not parallel to the disc of the dial.

4. Dial for a timepiece according to claim 1, wherein the elastic element is a blade.

5. Dial for a timepiece according to claim 4, wherein both ends of the blade are fixed on the skirt.

6. Dial for a timepiece according to claim 4, wherein the blade has a height less than or equal to 2 mm.

7. Dial for a timepiece according to claim 1, which comprises at least two elastic elements equally distributed about a periphery of the skirt to keep the skirt central relative to the timepiece.

8. Dial for a timepiece according to claim 1, which comprises at least one element forming an angular end stop.

9. Dial for a timepiece according to claim 1, wherein the skirt is made of metal and wherein the skirt has a thickness of from 0.2 to 0.4 mm.

10. Clockwork assembly, which comprises a timepiece movement collaborating with a dial according to claim 1.

11. Clockwork assembly according to claim 10, wherein the timepiece movement comprises at least one protrusion which projects radially with respect to another portion of an external contour of the timepiece movement to collaborate with the elastic element causing the elastic element to deform elastically as the protrusion and the elastic element are joined together.

12. Clockwork assembly according to claim 11, wherein the elastic element of the skirt of the dial comprises a hook able to cooperate with a complementary flank of a protrusion of the timepiece movement.

13. Clockwork assembly according to claim 11, wherein the protrusion of the timepiece movement forms an additional thickness of from 0.01 to 0.2 mm which corresponds approximately to the deformation of the elastic element of the dial with which it collaborates.

14. Clockwork assembly according to claim 10, which is suitable for supporting an underside face of (i) the disc of the dial or (ii) the skirt of the dial on a top face of at least one of (i) the timepiece movement and (ii) a protrusion from the contour of the timepiece movement.

15. Clockwork assembly according to claim 10, wherein the timepiece movement comprises an element forming an end stop, so as to perform angular indexing and to hold the dial angularly on the timepiece movement.

16. Wristwatch comprising a clockwork assembly according to claim 10.

17. Dial for a timepiece according to claim 3, wherein the first end of the elastic element which is fixed on the skirt is oriented in a direction substantially perpendicular to the disc of the dial.

18. Dial for a timepiece according to claim 8, wherein the at least one element forming an angular end stop is a side wall.

19. Clockwork assembly according to claim 12, wherein the hook is able to come into abutment with the complementary flank of the protrusion of the timepiece movement.

20. Dial for a timepiece according to claim 1, wherein the at least one elastic element is elastic with respect to a portion of the skirt body to which the at least one elastic element is fixed, and wherein the at least one elastic element is formed by a slit in the skirt.

21. Dial for a timepiece according to claim 1, wherein the at least one elastic element with respect to a portion of the skirt body to which the first end of the at least one elastic element is fixed.

22. Dial for a timepiece according to claim 1, wherein the at least one elastic element is in the form of an elastic blade oriented tangentially relative to an axis in an axial direction of the dial.

23. Dial for a timepiece according to claim 1, wherein the at least one elastic element extends in a direction substantially parallel to the disc of the dial.

24. Dial for a timepiece according to claim 1, wherein the at least one elastic element is formed by a slit in the skirt.

25. Dial for a timepiece according to claim 24, wherein the slit is substantially parallel to the disc of the dial.

26. Dial for a timepiece according to claim 1, wherein the first end of the at least one elastic element is fixed to the skirt body along a substantially vertical articulation line, and wherein at least a portion of the at least one elastic element moves about the articulation line in a direction that is substantially parallel to the plane defined by the disc of the dial.

27. Dial for a timepiece according to claim 1, wherein the at least one elastic element is configured to be moved from a rest position to an end position, and wherein an entirety of the movement between the rest position and the end position is in a direction substantially parallel to the plane defined by the disc of the dial.

* * * * *